United States Patent [19]

Marie

[11] Patent Number: 4,641,739

[45] Date of Patent: Feb. 10, 1987

[54] DEVICE FOR LOCKING AND RELEASING OBJECTS INTENDED FOR PUBLIC USE, SUCH AS LUGGAGE CARTS

[75] Inventor: Jean-Pierre E. Marie, Boulogne-Billancourt, France

[73] Assignee: Mors, France

[21] Appl. No.: 657,528

[22] Filed: Oct. 4, 1984

[30] Foreign Application Priority Data

Sep. 7, 1984 [FR] France ..... 84 13803

[51] Int. Cl.[4] ..... G07F 17/10

[52] U.S. Cl. ..... 194/253; 194/905

[58] Field of Search ..... 194/205, 210, 212, 213, 194/257, 253, 905

[56] References Cited

U.S. PATENT DOCUMENTS

| | | | |
|---|---|---|---|
| 441,536 | 11/1890 | Cornell | 194/248 |
| 608,186 | 8/1898 | Doldt | 194/294 |
| 608,769 | 8/1898 | Gilmer | 194/282 |
| 2,753,970 | 7/1956 | Breeler | 194/283 |

FOREIGN PATENT DOCUMENTS

| | | |
|---|---|---|
| 246487 | 6/1911 | Fed. Rep. of Germany . |
| 400803 | 8/1924 | Fed. Rep. of Germany . |
| 661352 | 6/1938 | Fed. Rep. of Germany . |
| 718594 | 3/1942 | Fed. Rep. of Germany . |
| 866471 | 2/1953 | Fed. Rep. of Germany . |
| 1474887 | 7/1969 | Fed. Rep. of Germany . |
| 2252749 | 5/1973 | Fed. Rep. of Germany . |
| 2725530 | 12/1978 | Fed. Rep. of Germany . |
| 2900367 | 7/1979 | Fed. Rep. of Germany . |
| 2058890 | 5/1971 | France . |
| 2200874 | 4/1974 | France . |
| 2333687 | 7/1977 | France . |
| 2425682 | 12/1979 | France . |
| WO8201950 | 5/1982 | World Int. Prop. O. . |
| 8100107 | 6/1982 | World Int. Prop. O. . |

*Primary Examiner*—F. J. Bartuska

*Attorney, Agent, or Firm*—Steinberg & Raskin

[57] ABSTRACT

The present invention relates to a device for locking and releasing objects intended for public use, such as luggage carts, and comprising a slide constituted by two portions, a first portion, and a second portion separated from the first portion by an intermediate or shim element adapted to be displaced out of its housing by a component such as a magnetic key to allow the first portion to be displaced, by a pulling action exerted thereon, with respect to the second portion to thus unlock the object locked between two adjacent objects.

5 Claims, 4 Drawing Figures

DEVICE FOR LOCKING AND RELEASING OBJECTS INTENDED FOR PUBLIC USE, SUCH AS LUGGAGE CARTS

BACKGROUND OF THE INVENTION

The present invention relates to an improvement to the device for locking and releasing objects intended for public use, particularly objects intended to be put at the public's disposal free of charge, such as luggage carts in a railway station or an airport, shopping trolleys in a self-service store, which objects the public can take directly from a common stowage space and must be taken back to the said stowage space, which device is described in U.S. patent application Ser. No. 515,372 filed on July 18, 1983 now U.S. Pat. No. 4,589,538.

There is already known a device including a locking apparatus allowing each object to be automatically locked to the adjacent object or to a fixed point in stowed position, into which locking apparatus is introduced a coin or the like authorizing the unlocking of the locking apparatus and the release of the object by exerting a pull thereon, said locking apparatus being designed to return the said coin when the object is returned to the stowage space and locked to an adjacent object or to a fixed point, and the unlocking is obtained by the said pull, which ensures successively the unblocking of the locking apparatus and the release of the said object. The locking apparatus includes particularly a slide which is movable under the action of the said pull and fixable by an internal locking member which is movable to a non-blocking position by coming into contact with the edge of the said coin, the said slide serving to lock or unlock the lock connecting the object to an adjacent object or to a fixed point.

However, such a device suffers from a disadvantage which consists in that the introduction of a coin does not allow unlocking an intermediate object from a line of objects locked to one another, for all the front and rear clearances of the intermediate object are insufficient and even eliminated.

SUMMARY OF THE INVENTION

The present invention therefore has for a purpose to remedy this disadvantage by providing a device for locking and releasing objects intended for public use, such as luggage carts, of the type described above, and characterized in that the said slide is constituted by two portions, a first portion serving to perform the said locking and unlocking of the connecting lock, a second portion, separate from the first portion and located towards an end portion of the casing of the locking apparatus, and characterized also in that an intermediate element is housed between the first and second portions so as to maintain a distance of separation between the first and second portions of the slide substantially equal to the slide travel necessary for unlocking the connecting lock, the said intermediate element being partially displaceable out of its housing by an appropriate means to allow the first portion of the slide to be moved under the action of the said pull with respect to the second portion of the slide over the said distance of separation, thus unlocking the said object from the adjacent object, particularly when it is locked between two adjacent objects.

According to another feature of the invention, said intermediate element is a substantially rectangular metal plate having two of its free sides adjacent to two corresponsding shoulders of the first and second portions of the slide, respectively, and maintained between the first and second portions by a resilient straight element one end of which is connected to the said intermediate element, whereas its other end is connected to one of the said first and second portions of the slide.

According to still another feature of the invention, the said means is in the form of a magnetic key extending throughut the casing of the locking apparatus and attracting one of the said two free sides of the metal plate out of the corresponding said shoulder.

BRIEF DESCRIPTION OF THE DRAWINGS

For a fuller understanding of the invention, reference is made to the following description, taken in connection with the accompanying drawings, in which.

DESCRIPTION OF THE PREFERRED EMBODIMENT

Figure 1:
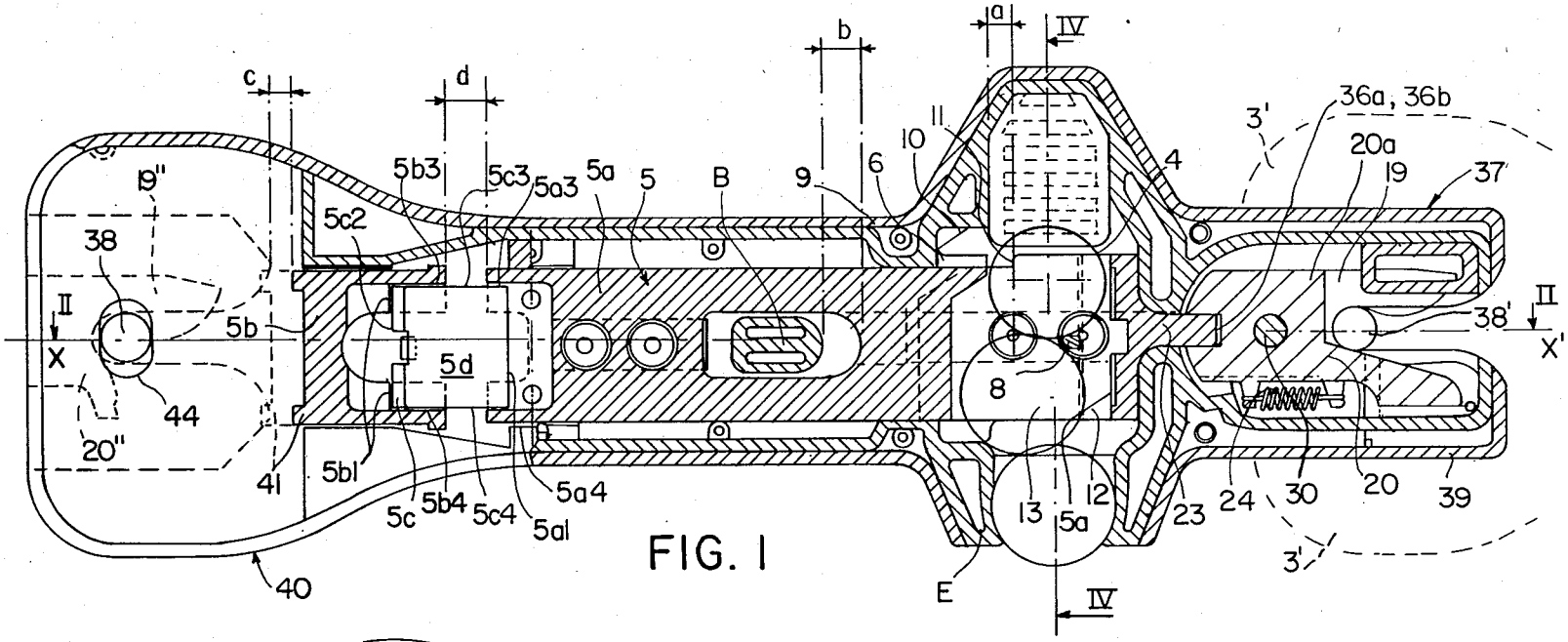
FIG. 1 is a sectional view upon the line I—I of FIG. 2, illustrating one example of embodiment of a locking apparatus according to the invention.

The device according to the invention allows several luggage carts (not shown) in stowed position to be locked to one another.

Referring to the Figures, the device includes a locking apparatus 3 allowing each object to be automatically locked to the adjacent object or to a fixed point in stowed position, and into which a coin or the like 4 is introduced to allow unlocking the locking apparatus 3 and releasing the object by exerting a pull thereon, the locking apparatus 3 being designed to return the coin 4 when the object is taken back to the stowage space and locked to an adjacent object or to a fixed point; in particular, said pull ensures successively the unblocking of the lock 3 and the unlocking of the object.

As will be recalled, the locking apparatus 3 includes a slide 5 which is movable under the action of the said pull and is fixable by an internal blocking member 6 and unblockable when a sufficient pull is exerted by coming into contact with the edge of the coin 4, the slide 5 serving to lock or unlock the lock 37 connecting the object to an adjacent object or to a fixed point.

In the example illustrated, the blocking member is constituted by a stop or abutment 6 pivotally mounted on a pivot pin 9 which is substantially horizontal and perpendicular to the longitudinal axis X—X' of the locking apparatus 3. The stop 6 may be acted upon by a U-shaped-stripreturn-spring 10.

The movable slide 5 has a shoulder 11 at its upper surface opposite the free end of the stop 6. When no coin is introduced into the locking apparatus and when a pull is exerted on the object, the free end of the free stop moves into abutment against the shoulder 11, thus preventing the unlocking of the locking apparatus.

Figure 4:
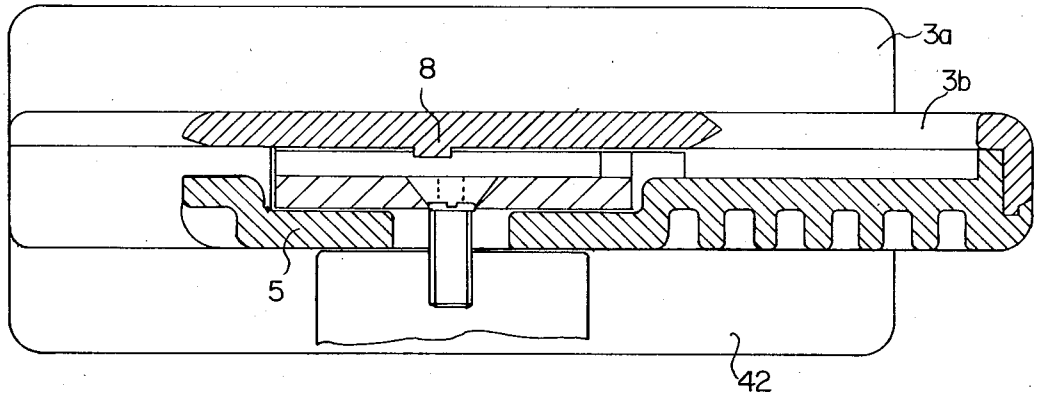
FIG. 4 is a sectional view upon the line IV—IV of FIG. 1.

The locking apparatus 3 also includes a means 8 for retaining the coin 4 in either of two positions in which the coin is confined in the locking apparatus, i.e., an active retained position ensuring the unblocking of the locking apparatus 3 and an inactive retained position, respectively. As illustrated in the Figures and more particularly in FIG. 4, the retaining means 8 consists of a projection cast integral with the internal face of the cover 3a of the locking apparatus and occupies a definite position in the recess 12 of the slit 13 extending throughout the locking apparatus, said projection 8 being located substantially at the longitudinal axis X—X' of the said apparatus. Such a projection advantageously replaces the rocker and spring of the retaining means described in U.S. patent application Ser. No. 515,372 filed on July 18, 1983 and allows a considerable saving of time in mounting the locking apparatus and a higher reliability thereof (doing away with the movable parts) while at the same time having no unfavorable effect upon the operation of the device. Indeed, up to a given value of the pulling action, i.e., up to a certain displacement of the slide 5 towards the left (in FIG. 1) with respect to the projection 8, the latter retains the coin 4 in the slit 13 in its active position ensuring the unblocking of the locking apparatus 3. When this predetermined value is exceeded, the coin 4 moved down in the slit 13 by gravity and assumes an inactive retained position as shown in dash-dotted lines in FIG. 1. The coin 4 is maintained in the inactive position by resting, on the one hand, on the vertical wall 5a (in dash-dotted lines) of the slide 5 and, on the other hand, on the upper curvilinear portion of the recovery funnel 2. When the object is taken back to the stowage space and is locked to an adjacent object or to a fixed point, the slide 5 moves to the right (in FIG. 1) so as to release the coin from the slit 13 and thus allow it to be recovered. FIG. 1 shows the total travel b of the slide during the unlocking of the connecting lock 37, this travel being defined between an abutment portion B integral with a fixing element 42 to which the locking apparatus 3 is fixed and a rounded endmost edge of an opening provided in the slide along the axis X—X' and in which the abutment B is located, the convex portion of this edge being directed towards the projection 8.

Figure 2:
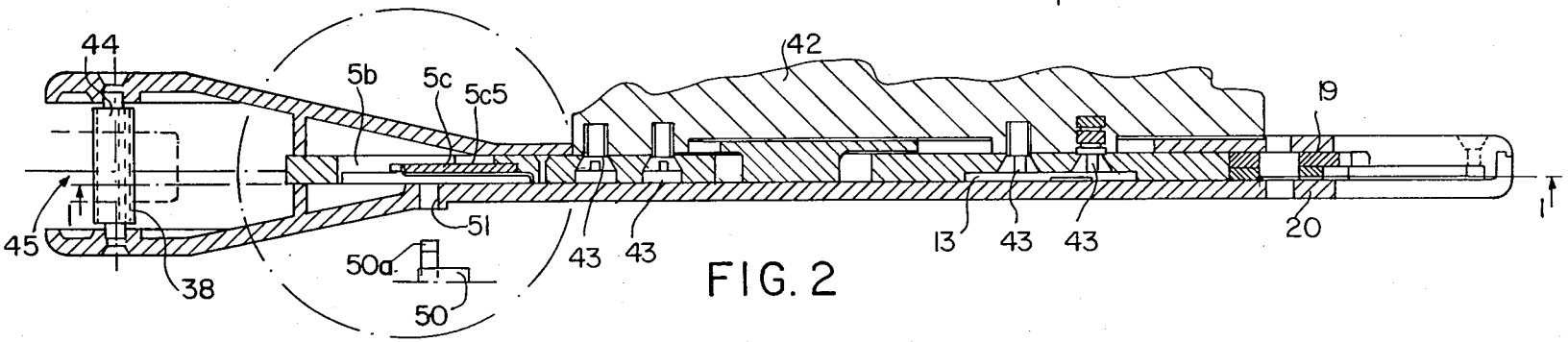
FIG. 2 is a sectional view upon the line II—II of FIG. 1.

The lock 37 for connecting the object to an adjacent object whose locking apparatus 3' is represented by dotted lines is constituted by first, female means 19, 20 and second, male means 38, connected to the longitudinally endmost portion 39, 40 of the casing of the locking apparatus 3, respectively. The said first means connected to the longitudinal end 39 of the locking apparatus 3, i.e., as in the example illustrated, the end in the right portion of FIG. 2, is constituted in particular by a clamp consisting of two unsymmetrical jaws 19, 20 acted upon by a spring 30 and so designed that only a connecting bar or locking pin 38 constituting the aforesaid second means of an adjacent object and whose diameter is perfectly calibrated,can fit in therebetween. In the example illustrated, the connecting bar 38 is connected to the endmost portion 40 of the casing of the locking apparatus 3 (in the left portion of FIG. 2) adjacent to the free end 41 of the slide 5, and, in the locked position, is spaced from the latter a sufficient distance to allow said bar to be introduced between the jaws 19", 20" (only the endmost portion of the latter being shown in dotted lines) of the locking apparatus of an adjacent object.

Thus, in the unlocked position, the free end 41 of the slide 5, shown in FIG. 1 in dotted lines, prevents the locking of the cart to another cart. Indeed, the space then formed between the connecting bar 38 and the free end 41 of the slide 5 is sufficient to allow the introduction of the bar 38 between the jaws 19", 20" of another cart. Thus, in case a cart is abandoned, it is no longer possible, owing to such design of the locking apparatus, to use its locking pin for locking one's cart. In other words, one cannot lock his cart to another cart unless the latter is already locked.

The movable slide 5 is also provided with a tongue 23 holding the jaws 19, 20 of the clamp in closed position . To this end, the jaws 19, 20 are provided, on their innermost portion in the locking apparatus, with mutually opposite recesses 36a, 36b which, in the locked position of the locking apparatus, define a space in which the tongue 23 is located so as to block the locking apparatus in this position.

The locking apparatus 3 is secured to a cart by the fixing member 42 through the medium of appropriate fastening means 43 such as screws, bolts or the like.

Furthermore, there may be provided an oblong recess 44 for the calibrated bar 38 so as to compensate for the differences in height between the carts, and an opening 45 in the endmost portion 40 of the locking apparatus 3 so dimensioned as to provide a lateral clearance between the carts.

The operation of the locking apparatus has already been described in detail in U.S. patent application Ser. No. 515, 372 filed on July 18, 1983 and, therefore, needs not be described again here.

Once the locking apparatus 3 is locked, on the one hand, by means of its jaws 19, 20, to the locking pin 38' of the locking apparatus 3' of an adjacent object and, on the other hand, by means of its locking pin 38, to the jaws 19", 20" of another adjacent cart, it is no longer possible, by introducing a coin, to release the object from the adjacent object standing on the right side (according to FIG. 1). Indeed, a pull exerted on the object towards the left (according to FIG. 1) results in a displacement, in the same direction, of the slide 5, i.e., a slide travel c defined between the free end 41 of the slide and the free ends of the jaws 19", 20". Since the travel c is smaller than the total travel b of the slide 5 defined previously, the tongue 23 maintains the clamp jaws 19, 20 in the locked position.

The present invention allows removing the above drawback.

To this end, the slide 5 is constituted by two portions, i.e., a first portion 5a constituting the slide portion serving to lock or unlock the connecting lock 37 of the object to an adjacent object, and a second portion 5b completely separate from the first portion and located near the endmost portion 40 of the casing of the locking apparatus 3. The said first and second portions are spaced from one another a distance d along the axis X—X' by an intermediate or shim element 5c in the form of a substantially rectangular metal plate. The plate 5c is located in a cavity defined between the first and second portions 5a and 5b and having two lateral walls perpendicular to the axis X—X' of FIG. 1 defined by two shoulders 5a1 and 5b1 respectively, of the first and second portions adjacent to the free opposite sides 5c1 and 5c2 of the plate 5c, the upper and lower sides 5c3 and 5c4 of the plate 5c which are parallel to the axis X—X' being adjacent to the upper walls 5a3 , 5b3 and the lower walls 5a4, 5b4 of the cavity. As shown particularly in FIG. 2, the plate 5c bears partially by its face 5c5, on the one hand, against a face 5a2 of the first portion 5a perpendicularly connecting with the shoulder 5a1 and parallel to the axis X—X' and, on the other hand, against a face 5b2 of the second portion 5b perpendicularly connecting with the shoulder 5b1 and parallel to the axis X—X', the said faces 5a2 and 5b2 constituting the bottom of the cavity in which the plate 5c is housed and connecting with the end edges 5a5 and 5b5, respectively, of the first and second portions 5a and 5b and spaced a distance d. The width of the shoulders 5a1 and 5b1 is substantially the same as the thickness of the plate 5c.

A flat face 5b6 parallel to the axis X—X' and spaced from the internal wall 3a1 of the cover 3a of the locking apparatus 3 connects with the shoulder 5b1.

A resilient straight element 5d in the form of a thin metal plate bears upon the face of the metal plate 5b confronting the face 5c5 and connected at one of its free ends to the plate 5c through the medium of a hook portion 5d1 extending through an opening in the form of a slot 5c6 provided on the free side 5c2 adjacent to the shoulder 5b1. The resilient plate 5d extends beyond the plate 5c and has its other end secured between a corresponding flat face of the first portion 5a and a washer 5e pressed against the resilient plate 5d through the medium of, for example, a rivet or the like. It is understood that the plate 5c is maintained in position between the shoulders 5a1 and 5b1 by the resilient plate 5d. Of course, the resilient plate 5d may be secured to the second portion 5b of the slide with the hook portion located in proximity to the shoulder 5a1.

Figure 3:
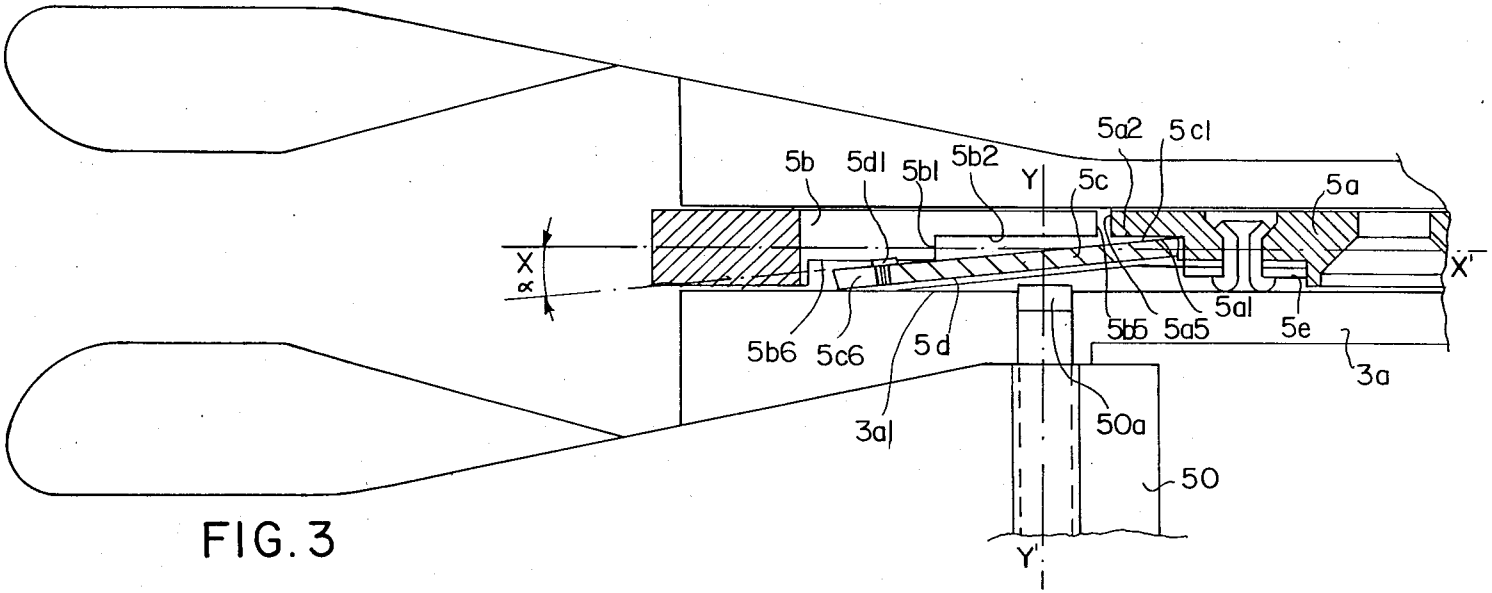
FIG. 3 is an enlarged view of the portion encircled by a dash-dotted line in FIG. 2.

There also appears in FIGS. 2 and 3 a lock device including a special service key, particularly a magnetic key 50, adapted to be inserted into a corresponding lock hole 51 provided through the wall of the cover 3a of the locking apparatus 3 and opening into the interior of the latter in proximity to the end side 5c2 of the metal plate 5c, the axis Y—Y' of the lock hole being perpendicular to the plate 5c and approximately intersecting the longitudinal axis X—X' of FIG. 1, the plate side 5c3 being substantially aligned with the axis X—X'.

FIG. 3 shows the magnetic key 50 inserted into its corresponding lock hole. In this position, a magnet 50a located at the free end of the key is placed adjacent to the face of the metal plate 5c opposed to the face 5c5 of the latter. The magnet then attracts the end portion of plate 5c including the side 5c2, which therefore is outside the shoulder 5b1 and bears upon the internal face 3a1 of the lateral wall of the cover 3a of the casing of the locking apparatus 3 so that the plate 5c is inclined with respect to the axis X—X'. FIG. 3 shows the angle $\alpha$ of inclination of the upper side 5c3 of the plate 5c with respect to the axis X—X'. By exerting a pull on the object, the first portion 5a of the slide 5 is displaced with respect to the second portion 5b in a direction towards the left in FIG. 2. Simultaneously with this displacement of the first protion 5a, the end portion including the side 5c2 of the plate 5c enters the space defined between the face 5b6 and the internal face 3a1 of the lateral wall of the cover 3a. FIG. 3 precisely shows the endmost position of the edge 5a5 of the first portion 5a at the end of the travel of the latter (d then being substantially equal to 0). In this endmost position of the first portion 5a of the slide 5, the connecting lock 37 is unlocked, thus allowing the object to be unlocked from the locking pin 38' of the adjacent cart. It is therefore understood that the slide 5 thus designed allows an authorized person possessing the magnetic key 50 to unlock an intermediate object or cart from a line of objects locked to one another.

The said autorized person can thereafter exert a push on the object resulting in a displacement towards the right of the portion 5a of the slide 5 till the endmost position of the latter, i.e., till the separating distance d is again reached. The said person then withdraws the magnetic key 50 from its lock hole and the resilient plate acts upon and returns the free side 5c2 to a position opposite the shoulder 5b1, the plate 5c thus being again located between the shoulders 5a1 and 5b1 as shown in FIG. 2.

Of course, the lock hole 51 is a complex hole in order to prevent an unauthorized person from inserting therein a magnetized means allowing the aforedescribed unlocking.

What is claimed is:

1. A device for locking and releasing objects intended for public use, such as luggage carts, including a locking apparatus allowing each object to be automatically locked to an adjacent object or to a fixed point in stowage position and into which a coin can be inserted to allow unlocking of the locking apparatus and releasing of the object by exerting a pull thereon, said unlocking being ensured by said pull, said locking apparatus including a casing, a slide displaceable by said pull, an internal blocking member for fixing said slide and which is movable to a non-blocking position by coming into contact with an edge of the coin, and a connecting lock for locking the object to the adjacent object or to the fixed point, said slide serving to lock or unlock said connecting lock connecting the object to the adjacent object or to the fixed point, wherein said slide is constituted by two portions, a first portion for said locking and unlocking of said connecting lock, a second portion separate from said first portion and located near an endmost portion of said casing of the locking apparatus, and additionally comprising an intermediate element housed between said first and second portions forming a housing therefor so as to maintain between said first and second portions of said slide a separating distance substantially equal to slide travel necessary for unlocking said connecting lock, and means for allowing said first portion of said slide to be displaced by said pull with respect to said second portion over said separating distance, said intermediate element being partially displaceable out of said housing between said first and second portions by said means, thus unlocking the object from the adjacent object.

2. A device according to claim 1, wherein said housing of said intermediate element comprises two lateral walls respectively defined by two shoulders of said first and second portions, said intermediate element is a substantially rectangular metal plate, two opposite sides of which are respectively adjacent to said two shoulders, and additionally comprising a resilient straight element for maintaining said substantially rectangular metal plate between said two shoulders, said resilient straight element having one of its ends connected to said intermediate element and its other end connected to one of said first and second portions of said slide, and wherein said means are in the form of a magnetic key adapted to pass through a hole in said casing of said locking apparatus for attracting an endmost portion of said plate which is one of said two opposite sides thereof, out of said corresponding shoulder.

3. A device according to claim 2, wherein said resilient straight element is a thin metal plate bearing flat against a face of said metal plate forming said intermediate element adjacent to said hole for the passage of said magnetic key and extending beyond said intermediate element plate to form said other end connected to one of said first and second portions of said slide.

4. A device according to claim 3, wherein said one end of said resilient element metal plate is provided with a hook portion passing through a corresponding opening of said intermediate element metal plate, and said other end of said resilient element is connected to said first portion of said slide.

5. The device of claim 4, wherein said other end of said resilient element is connected by riveting to said first slide portion.

* * * * *

UNITED STATES PATENT AND TRADEMARK OFFICE

CERTIFICATE OF CORRECTION

PATENT NO. : 4,641,739

DATED : February 10, 1987

INVENTOR(S) : Jean-Pierre Etienne Marie Stremler

It is certified that error appears in the above-identified patent and that said Letters Patent is hereby corrected as shown below:

On the Title Page, Item [19] "Marie" should read -- Stremler --.

Item [75] should read

-- [75] Inventor: Jean-Pierre Etienne Marie Stremler,
Boulogne-Billancourt, France --.

Signed and Sealed this

Fifteenth Day of September, 1987

*Attest:*

DONALD J. QUIGG

*Attesting Officer*

*Commissioner of Patents and Trademarks*